United States Patent [19]

Alheid

[11] 4,387,663

[45] Jun. 14, 1983

[54] BLADE TYPE FOUNTAIN COATER METERING DEVICE

[75] Inventor: Robert J. Alheid, Beloit, Wis.

[73] Assignee: Beloit Corporation, Beloit, Wis.

[21] Appl. No.: 309,189

[22] Filed: Oct. 7, 1981

[51] Int. Cl.[3] ..... B05C 3/02

[52] U.S. Cl. ..... 118/413; 118/419

[58] Field of Search ..... 427/209, 356; 118/413, 118/419

[56] References Cited

U.S. PATENT DOCUMENTS 4,250,211 2/1981 Damrau et al. ..... 427/355 X 4,327,662 5/1982 Damrau ..... 118/413

*Primary Examiner*—Bernard D. Pianalto

*Attorney, Agent, or Firm*—Hill, Van Santen, Steadman, Chiara & Simpson

[57] ABSTRACT

Pond pressure controlling device, e.g. a tiltably mounted metering lip baffle is mounted on the floor area which in part defines with an upstanding doctor blade and rib running on the backing surface roll a coating application pond chamber, provides an adjustable output orifice for the chamber spaced from the blade at an upstream location relative to the direction of travel of the web. A pressure fluid responsive device, e.g. an inflatable bladder, is adapted for selectively adjusting the pond pressure controlling lip baffle for obtaining a desired output orifice dimension. In another form the controlling device may comprise simply an inflatable tubular bladder mounted on the floor area provided with any adjustable orifice-defining rib.

10 Claims, 3 Drawing Figures

BLADE TYPE FOUNTAIN COATER METERING DEVICE

BACKGROUND OF THE INVENTION

1. Field of the Invention

This invention relates to improvements in blade type fountain coaters especially suitable for applying coating materials to paper webs, and more particularly concerns a novel metering device for such coaters.

2. Description of the Prior Art

Coating apparatus of the type with which the present invention is concerned is particularly adapted for so-called short or zero dwell coating, attaining maximum transfer of coating material from a suspension onto the surface of a continuously running web, with minimum or virtually no soaking of the material into the body of the web. Basic principles of such apparatus have been disclosed in Neubauer U.S. Pat. No. 3,348,526. According to that patent, which is incorporated herein by reference for a more detailed explanation of the underlying principles, coating material is supplied to and along a coating nip of a generally upwardly projecting doctor blade extending across the width of a web travelling continuously on backing surface means such as a roll.

A more recent Damrau et al U.S. Pat. No. 4,250,211 discloses various alleged improvements on the apparatus first disclosed in the aforesaid U.S. Pat. No, 3,348,526. Among the expedients in the more recent patent, is an arrangement whereby a partially enclosed coating chamber or pond converges toward a coating nip defined by and between an upstanding doctor blade, and an upstanding, slidably adjustable orifice plate has an upper edge which defines a metering orifice slot for controlling back pressure in the coating application chamber pond. In one form, the orifice plate is secured adjustably by screws which extend through slots in the plate. In another form the plate is slidably adjustable by manipulation of various screw jack devices. These prior arrangements lack convenience and in certain aspects are complicated and cumbersome.

SUMMARY OF THE INVENTION

It is, therefore, an important object of the present invention to overcome the disadvantages, drawbacks, inefficiencies, shortcomings and problems in prior structures of the character indicated.

To this end, the present invention provides in a fountain coating applicator especially suitable for paper web coating and including a generally upwardly projecting doctor blade having an upper edge for coating nip relation across the width of a web travelling continuously on backing surface means, means for delivering coating material, and means extending across the width of the web for supplying the coating material from said delivering means under hydraulic pressure to said coating nip within a coating application pond chamber defined in part by said doctor blade and said web running on said locking surface means and in addition by an application chamber floor area spaced below said nip, the improvements comprising in one aspect pond pressure controlling means associated with said floor area providing an adjustable outlet orifice for said chamber and spaced from said blade at an upstream location relative to the direction of travel of said web, and pressure fluid responsive means for selectively adjusting said pond pressure controlling means for attaining a desired orifice dimension, and in another aspect, tiltably mounted pond pressure controlling metering lip baffle means associated with said floor area and providing an adjustable outlet orifice for said chamber spaced from said blade at an upstream location relative to the direction of travel of said web, and means for selectively adjusting said baffle means for attaining a desired pond pressure controlling orifice dimension.

Other objects, features and advantages of the present invention will become apparent from the sheet of drawings, in which:

DESCRIPTION OF THE PREFERRED EMBODIMENTS

Figure 1:
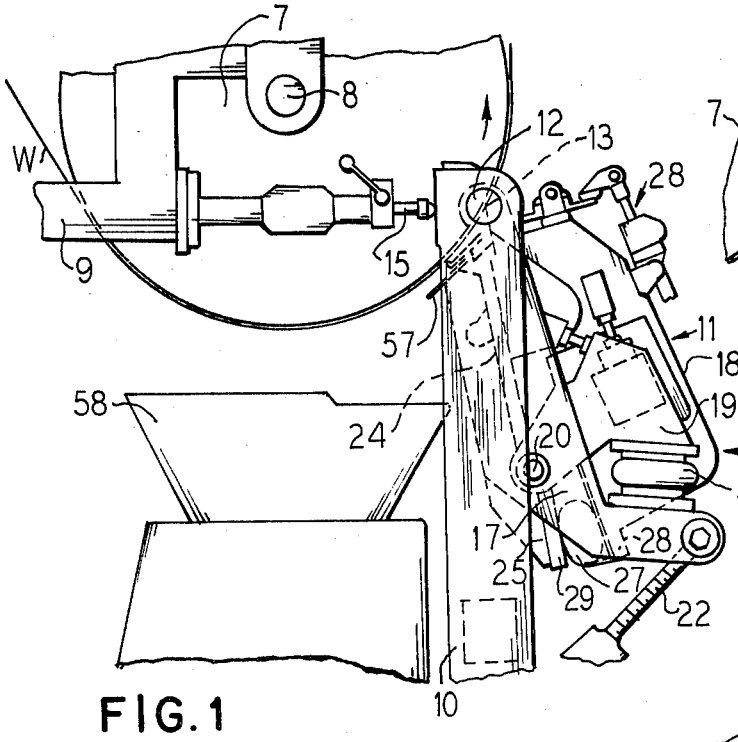
FIG. 1 is a fragmentary more or less schematic, illustrative side elevational view of a coating apparatus embodying the invention.

A blade type fountain coater apparatus 5 is adapted to be properly related for applying coating material as a suspension to a web W such as paper travelling continuously on backing surface means conveniently in the form of a back-up roll 7 which preferably has an elastic perimeter. Journal means 8 rotatably support the roll 7 in a machine frame 9, and suitable means (not shown) drive the roll at a desirable peripheral speed.

Mounting of the coater 5 is by means of a frame 10 upstanding from a suitable base (not shown) and comprising a pair of arms, of which the left-hand one is shown when facing toward a coater head structure 11 supported by pivot means 12 on upper end portions of the frame arms and with the axes of the pivots aligned with the perimeter of the roll 7 and a coating nip 13 defined in cooperation with the roll 7 by the upper edge of an upwardly projecting resiliently flexible doctor blade 14 carried by the coater head 11. An adjustable stop 15 facilitates alignment of the pivots 12 with the roll perimeter.

Means for mounting the coater head 11 on and between the arms of the frame 10 comprise a pair of depending substantially dog-leg shaped swingably adjustable support arms 17, one of which is located at each side of the head 11 and has its upper end pivotally connected by the pivot 12 of the adjacent arm of the frame 10. The coater head 11 comprises a hollow rigid beam body 18 preferably of a length at least equal to the length of the roll 7. Means for adjustably mounting the body 18 on and between the arms 17 comprise a pair of side arms 19, only one of which is shown in FIG. 1, but there being a duplicate at the opposite side of the body 18. Forwardly projecting portions of the arms 19 are attached by pivot means 20 to the respective inner sides of the side arms 17, and thereby swinging adjustments of the head 11 toward and away from the coating nip relation to the roll 7 are adapted to be effected. For adjustment of the beam body 18 about the pivot 20, air spring means 21 are mounted on lower end rearward extensions of the arms 17, a screw jack meand 22 connected between the frame 10 and the rear end portions of the arms 17 are adapted to effect primary adjustments of the coater head 11. An adjustable thruster 23 structure is adapted to effect fine adjustments of the doctor blade 14.

Coating material is adapted to be supplied to the coating nip 13 from a supply chamber 23 defined by a cavity in the body 18 and a plate 24 which is carried by an arm structure 25 pivotally connected to the side arms 17 by means of the pivots 20 and adapted for controlling the disposition of the plate 24 relative to the body 18 by means of a pneumatic tube 27 interposed between a jaw 28 provided on the lower portion of the body 18 and a complementary jaw 29 on the lower end of the arm 25.

Figure 2:
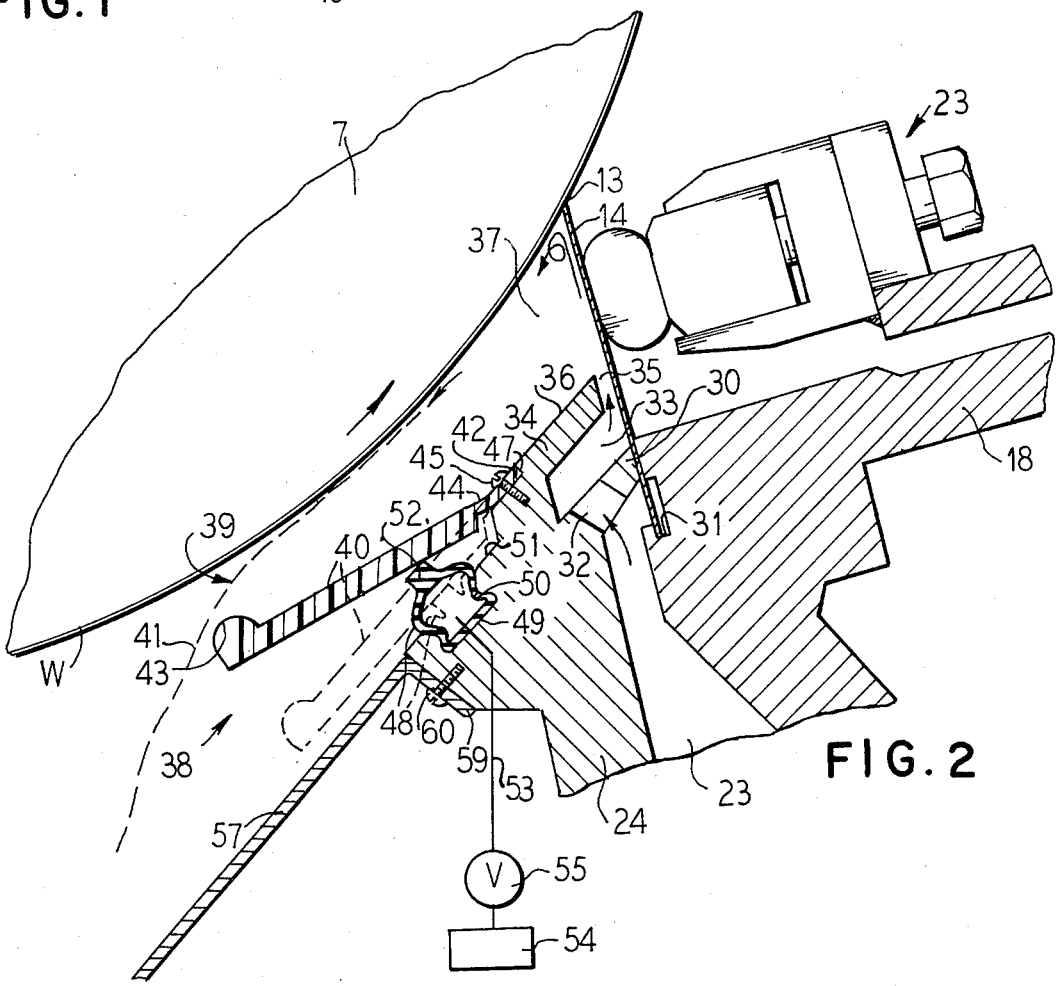
FIG. 2 is an enlarged fragmentary vertical sectional view, partially schematic, showing one embodiment of pond pressure controlling means in accordance with the principles of the present invention.

On the upper portion of the plate 24 a combination partition and clamping flange 30 releasably clamps the lower portion of the blade 14 to the body 18, the lower edge of the blade being received on a shoulder 31 on the body 18 below the blade clamping area. Coating material passes under hydraulic pressure from the chamber 23 through a plurality of pressure drop ports 32 located along the length of the flange 30 into a mixing or turbulence chamber 33 defined between the flange 30 and a flange 34 on the plate 24 spaced above the flange 30 and defining with the blade 14 a slit ejection orifice 35 from which the coating material is uniformly ejected to the coating nip 13, substantially as indicated by the flow arrows in FIG. 2. A floor area 36 is provided by the top of the plate 24, including the flange 34, for a coating application chamber 37 which is further defined by the blade 14 and the backing roll 7 with the web W running thereon. It will be appreciated that the length of the chamber 37 is at least coextensive with the width of the web W to be coated and may be equal in length to the length of the roll 7. At its opposite ends, the chamber 37 is sealed by end dams (not shown) as is customary with this type of applicator.

For optimum results, pressure in the coating material pond in the chamber 37 should be reasonably carefully controlled. To maximize coating on the coated surface of the web W consistent with the particular coating effect desired, especially for printing paper where particular print properties are required, pond pressure controlling means 38 are provided at an upstream location relative to the direction of travel of the web W and spaced from the blade 14, for defining an adjustable outlet orifice 39 for the chamber 37. In one desirable form, the pond pressure controlling means 38 includes a tiltably mounted metering lip baffle member 40 which should be at least as long as the length of the chamber 37 and is of ample width to permit control of the orifice 39 throughout the desired range. Inasmuch as the coating nip 13 is located under the uprunning side of the backing roll 7, discharge flow of surplus coating material 41 from the chamber 37 is generally downwardly and away from the nip 13 in a generally upstream direction relative to the direction of rotation of the roll 7 and travel of the web W. Therefore, the baffle 40 is mounted on the floor area 36 intermediate upstream and downstream edges of the area to extend widthwise in a direction away from the blade 14 from an anchored edge portion 42 to a metering lip 43. In a preferred construction, the baffle member 40 is made from a suitable plastic such as nylon which is characterized by high abrasion resistance and may be extruded or cast to form. In its anchored edge portion 42, the member 40 is desirably thinner than the remainder of the body of the member so as to take advantage of flexibility of the thinner section to provide a hinge 44 while the edge portion 42 is nevertheless securely fastened by means of a plurality of screws 45 therealong, desirably within an inset rabbet groove 47 in the head of the plate 24 whereby the upper surface of the portion 42 is located substantially in a plane with the top of the upper flange 34 of the plate. This facilitates flow of the material 41 toward the orifice 39. Orifice control is promoted by having the lip 43 in the form of a rounded rib which projects toward the roll 7.

Means for effecting tilting adjustments of the baffle 40 desirably comprises a simple elongate, tubular bladder member 48 suitably mounted along and under the baffle 40 as close to the hinge 44 as practicable to attain maximum leverage advantage. Desirably, the tubular member 48 has a base 49 which is complementally engaged in a dovetail groove 50 located in an inset upwardly facing ledge 51. A crown rib 52 on the inflatable member 48 projects toward and is engageable in upwardly thrusting relation against the baffle member 40 and is adapted by inflation of the tubular member to move from a reverted position as shown in dash outline to an extended baffle tilting position as shown in full outline. By controlling the inflation of the member 48 the degree of tilting of the baffle 40 about the hinge 44 toward the overlying backing roll 7 is adjustable within extremely fine increments to attain the optimum width of the orifice 39 for just the right pond back pressure in the chamber 37 to attain the desired coating results in any adjusted relationship of the doctor blade 14 to the backing roll 7 and thereby the web W. Any suitable means may be provided for controlling inflation of the member 48 such, for example, as a duct 53 communicating with the chamber within the member 48 and deriving air pressure from a source 54 through a control valve 55 by which the degree of inflation of the member 48 is adjustable and adapted to be maintained during operation of the coater.

Excess coating material spilling through the orifice 39 is diverted by means of a fixed baffle 57 into a collecting pan 58 therebelow and from which the material may be fed back to a coating material source and recycled to the supply chamber 23. Attachment of the spill-over baffle 57 is desirably to the head portion of the plate 24 as by means of an attachment flange 59 on the baffle secured in place against the plate head as by means of screws 60. As mounted, the baffle plate serves, in effect, as an extension from the floor 36 of the chamber 37 with the tiltable metering baffle 40 associated with the floor 36 and intervening between the chamber 37 and the spill-over baffle plate 57.

Figure 3:
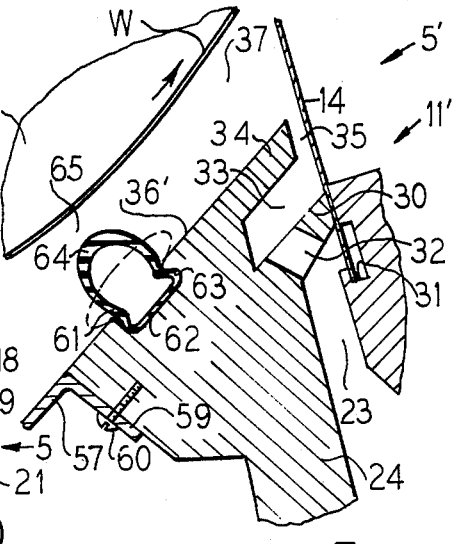
FIG. 3 is a view similar to FIG. 2 and showing a modification.

In a simpler form of the pond pressure controlling means, as represented in FIG. 3, there is simply provided a tubular inflatable bladder member 61 mounted on and in a location intermediate upstream and downstream edges of the floor area 36' which provides part of the coating application pond chamber 37. A base 62 of the member 61 is engaged retainingly in a dovetail groove 63 in the floor area 36' at the top of the plate 24. A substantial portion of the member 61 is adjustably projectable above the floor area 36' so that a crown rib 64 on the member 61 is adapted to define with the overlying backing roll 7 and more particularly the web W running thereon an adjustable outlet orifice 65 for the chamber 37. Inflation of the member 61 may be effected in similar fashion as described in connection with the member 48 in FIG. 2. As shown the member 61 is adapted to be inflated to adjust the orifice rib 64 throughout a substantial working range from a collapsed condition as indicated in dash outline to an extended and diminished orifice dimension, that is the effective cross-sectional flow area of the orifice 65. Such adjustment is adapted to be effected throughout a substantial range in minute increments by controlling inflation of the member 61, thereby attaining fine metering control at the orifice 65 and optimum control of pond pressure in the application chamber 37. Other elements of the fountain coating applicator 5' and the applicator head 11' in FIG. 3 which are identified by reference characters common to FIGS. 1 and 2, will be understood to be substantially the same and the same description applies as the same elements in FIGS. 1 and 2.

It will be apparent to those skilled in the art that many modifications and variations may be effected without departing from the spirit and scope of the novel concepts of the present invention.

I claim as my invention:

1. In a fountain coating applicator especially suitable for paper web coating and including a generally upwardly projecting doctor blade having an upper edge for coating nip relation across the width of a web travelling continuously on backing surface means, means for delivering coating material, and means extending across the width of the web for supplying the coating material from said delivering means under hydraulic pressure to said coating nip within a coating application pond chamber defined in part by said doctor blade and said web running on said backing surface means and in addition by an application chamber floor area of substantial length spaced below said nip, the improvement comprising:

pond pressure controlling means mounted on said floor area intermediate upstream and downstream edges of said floor area and adjustably moveable from and relative to said floor area for providing an adjustable outlet orifice for said chamber, said controlling means being spaced from said blade at an upstream location relative to the direction of travel of said web;

and pressure fluid responsive means for selectively adjusting said pond pressure controlling means for attaining a desired orifice dimension.

2. An applicator according to claim 1, wherein said pond pressure controlling means comprises a tiltably mounted pond pressure controlling metering lip baffle member having a hinged connection at said floor area and having an orifice lip for cooperation with said backing surface means and the web travelling thereon for defining the outlet orifice.

3. An applicator according to claim 2, wherein said pressure fluid responsive means comprises an inflatable bladder member cooperating between said floor area and said baffle member.

4. An applicator according to claim 1, wherein said pond pressure controlling means comprises an orifice defining rib carried by an inflatable bladder member providing said pressure responsive means.

5. An applicator according to claim 1, wherein said floor area comprises the top of a plate member forming part of a coater head providing said means for supplying coating material and supporting said doctor blade, and said pressure controlling means and pressure fluid responsive means are mounted on said plate.

6. In a fountain coating applicator especially suitable for paper web coating and including a generally upwardly projecting doctor blade having an upper edge for coating nip relation across the width of a web travelling continuously on backing surface means, means for delivering coating material, and means extending across the width of the web for supplying the coating material from said delivering means under hydraulic pressure to said coating nip within a coating application pond chamber defined in part by said doctor blade and said web running on said backing surface means and in addition by an application chamber floor area of substantial length spaced below said nip, the improvement comprising:

tiltably mounted pond pressure controlling metering lip baffle means mounted on said floor area intermediate upstream and downstream edges of said floor area and adjustably moveable from and relative to said floor area for providing an adjustable outlet orifice for said chamber, said controlling means being spaced from said blade at an upstream location relative to the direction of travel of said web;

and means for selectively adjusting said baffle means relative to said floor area and said backing surface means for attaining a desired pond pressure controlling orifice dimension.

7. An applicator according to claim 6, wherein said means for selectively adjusting comprises pressure fluid responsive means.

8. An applicator according to claim 6, wherein said pivotally mounted baffle means comprises a baffle member of a length at least as long as the width of said web and projecting from a hinged connection with said floor area in a direction away from said blade and having a lip spaced from the hinged connection and cooperating with the backing surface means and the web travelling thereover for defining said outlet orifice.

9. An applicator according to claim 6, wherein said means for selectively adjusting comprise an inflatable bladder located between said floor area and said baffle member.

10. An applicator according to claim 6, wherein said floor area comprises the top of a plate in an applicator head and which provides support for the doctor blade, said baffle means being carried by said floor area on the head of the plate.

* * * * *